US005222991A

United States Patent [19]

Bell

[11] Patent Number: 5,222,991

[45] Date of Patent: Jun. 29, 1993

[54] LANYARD WITH POLE GRIPPING MEANS

[76] Inventor: Michael Bell, 1705 Triumphe Way, Warrington, Pa. 18976

[21] Appl. No.: 868,063

[22] Filed: Apr. 13, 1992

Related U.S. Application Data

[63] Continuation-in-part of Ser. No. 824,654, Jan. 23, 1992.

[51] Int. Cl.[5] ..... A62B 35/00

[52] U.S. Cl. ..... 182/9; 182/133

[58] Field of Search ..... 182/9, 3-8, 182/187, 190-192, 133-136

[56] References Cited

U.S. PATENT DOCUMENTS

| | | | |
|---|---|---|---|
| 857,430 | 6/1907 | Youngquist | 182/134 |
| 869,382 | 10/1907 | Newton | 182/9 |
| 1,120,496 | 12/1914 | Holsclaw | 182/9 |
| 1,802,288 | 4/1931 | Strauss | 182/9 |
| 2,853,220 | 9/1958 | Thomas | 227/ |
| 3,407,898 | 10/1968 | Johnson | 182/9 |
| 3,840,091 | 10/1974 | Conlon | 182/9 |
| 4,407,391 | 10/1983 | Greenway et al. | 182/133 X |
| 4,579,196 | 4/1986 | Allen et al. | 182/9 |
| 4,595,078 | 6/1986 | Greenway | 182/9 |
| 4,712,646 | 12/1987 | Page | 182/9 |

*Primary Examiner*—Karen J. Chotkowski

*Attorney, Agent, or Firm*—Caesar, Rivise, Bernstein, Cohen, & Pokotilow, Ltd.

[57] ABSTRACT

A fall arrest lanyard for use by a worker at an elevated position on a pole, e.g., a telephone pole. The lanyard comprises a flexible strap and a pair of gripping units. The strap is arranged to be releasably connected to the worker to form a loop encircling the pole. Each of the gripping units comprises an elongated, rigid or semi-rigid tubular member having a handgrip at one end, and a first pole penetrating head adjacent the handgrip. In one embodiment, a second pole penetrating head is located at the other end of the tubular member. The strap extends through both tubular members. Each of the penetrating heads has a plurality of larger upper teeth and a plurality of small lower teeth. Each tooth has a horizontally disposed cutting edge. The gripping units are arranged to be manipulated by the worker grasping the handgrips to cause the cutting edges of the teeth to penetrate into the material of the pole.

14 Claims, 4 Drawing Sheets

LANYARD WITH POLE GRIPPING MEANS

BACKGROUND OF THE INVENTION

This application is a Continuation-In-Part of my earlier filed U.S. patent application Ser. No. 07/824,654, filed on Jan. 23, 1992 and still pending, entitled Lanyard With Pole Gripping Means, whose disclosure is incorporated by reference herein, and the invention hereof relate generally to safety apparatus and more particularly to a fall arrest device in the form of a lanyard having means for gripping a pole or other vertical member.

Safety devices for a person climbing a pole, e.g., a telephone pole, to prevent the person from falling have been disclosed in various patents. For example, in U.S. Pat. No. 1,120,496 (Holsclaw) there is disclosed a safety device for connection to telephone lineman's belt to encircle the pole on which the lineman is working. The safety device comprises a belt and an associated wheel frame for frictionally encircling the pole. The wheel frame includes a roller having spurs projecting from it to bite into the pole to prevent the device from slipping while enabling the lineman to swing around the periphery of the pole.

In U.S. Pat. No. 2,853,220 (Thomas) there is disclosed a safety device for a telephone lineman. That device comprises a sleeve having a plurality of substantially U-shaped prongs projecting from it. The sleeve is arranged to be positioned on a belt which is connected to a telephone lineman and which encircles the pole on which the lineman is located so that the prongs penetrate into the surface of the pole to prevent slippage of the belt on the pole.

In U.S. Pat. No. 4,595,078 (Greenway) there is disclosed a fall arrest device for a pole climber. That device includes a main yoke and secondary yokes for engaging the pole on which the climber is located. The main yoke has a pair of resiliently biased arms at each end for partially encompassing the pole. The arms include sharp projections to bite into the pole. Each arm also includes a hand grip to enable the worker to maneuver the arm to enable the device to be moved up or down on the pole.

While the devices of the aforementioned patents may be suitable for their intended purposes, they never the less suffer from one or more drawbacks, e.g., simplicity of construction, easy of use, and resistance to accidental displacement.

OBJECTS OF THE INVENTION

Accordingly, it is a general object of this invention to provide a device for use on poles or other vertical members which overcomes the disadvantages of the prior art.

It is a further object of this invention to provide a lanyard including means to grip a pole or other vertical member on which a worker connected to the lanyard is located.

It is another object of this invention to provide a fall arrest lanyard which includes readily operable means to grip a pole or other vertical member on which a worker connected to the lanyard is located, and which means is resistant to accidental dislodgement.

It is still another object of this invention to provide a fall arrest lanyard which is easy to use.

It is yet another object of this invention to provide a fall arrest lanyard which is simple in construction.

SUMMARY OF THE INVENTION

These and other objects of this invention are achieved by providing a fall arrest lanyard to protect a worker located at an elevated position on a pole or other structural member from falling thereof. The lanyard comprises a flexible strap and a pair of separate gripping units. The strap has a central longitudinal axis and is arranged to be releasably connected to the worker to form a generally horizontal loop encircling the pole.

Each of the gripping units comprises an elongated tubular member, and first and second penetrating heads. Each tubular member has a first end portion and a second end portion. The strap extends through each of the tubular members. Each of the first end portions of each tubular member is located adjacent the worker and is arranged to be grasped in a respective hand of the worker. Respective first penetrating heads are coupled to the first end portions of each of the tubular members. Respective second penetrating heads are coupled to the second end portions of each of the tubular members. Each of the penetrating heads includes penetrating means arranged for penetrating into the material making up the pole. Each of the penetrating heads is movable by the worker to cause its penetrating means to dig into the material making up the pole.

In accordance with one preferred embodiment of this invention the penetrating means of each penetrating head comprise a plurality upper and lower cutting edges projecting outward from the associated end portion of each tubular member. Each of the edges extends generally horizontally when the loop encircling the pole is horizontal, with the lower edges extending outward from the second end portion further than the upper edges.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
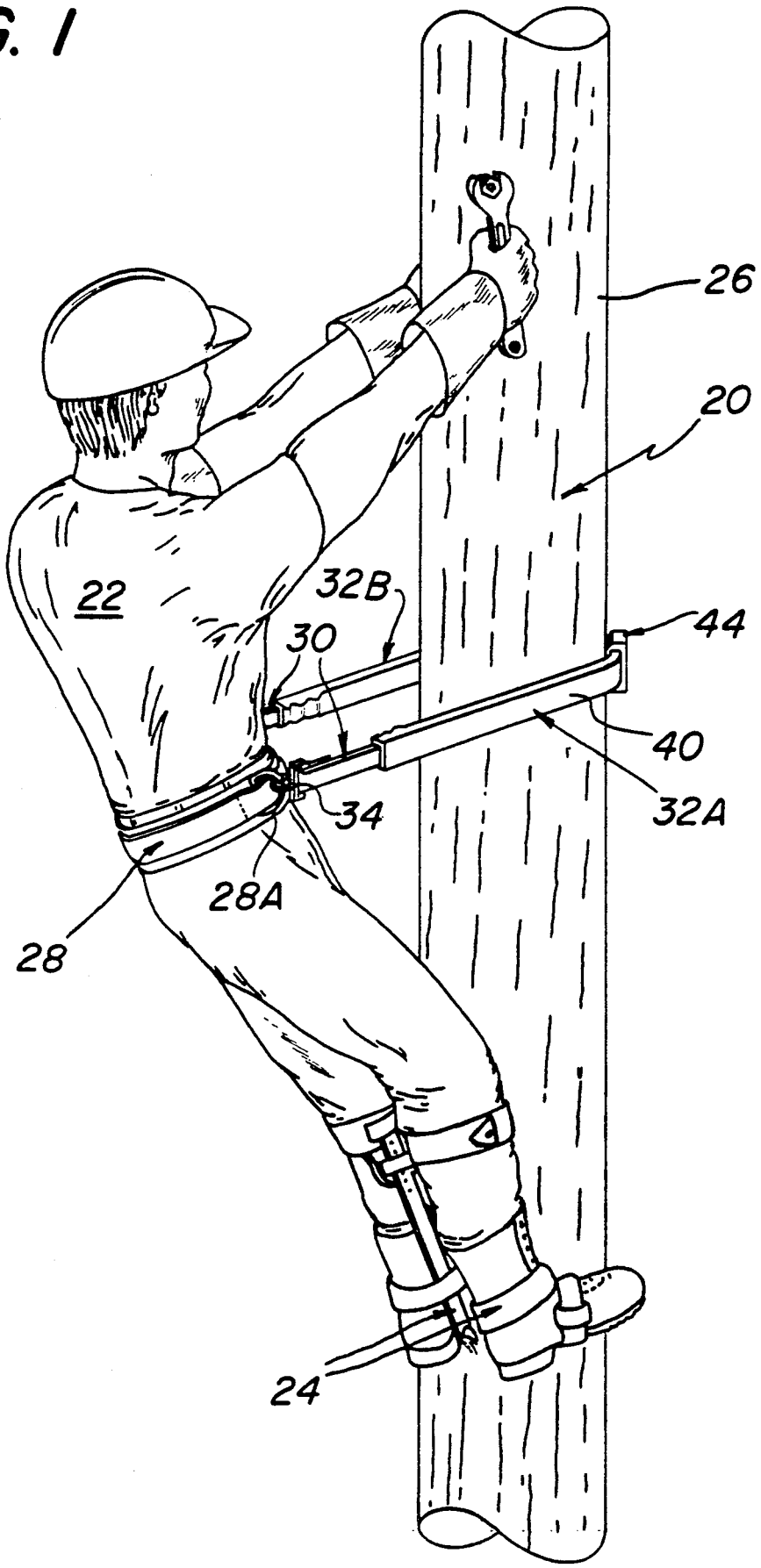
FIG. 1 is an isometric view of a worker using one embodiment of a fall arrest lanyard of the subject invention.

Referring now to the various figures of the drawing wherein like reference characters refer to like parts, there is shown at 20 in FIG. 1, fall arrest lanyard constructed in accordance with one embodiment of this invention. The lanyard 20 is arranged to be used by a worker 22 in conjunction with conventional pole climbing aids, e.g., spiked gaffs 24, worn on the worker's shoes so that the worker can climb up a pole or other vertically oriented structure, e.g., a telephone pole 26. Thus, the lanyard 20 includes first gripping means (to be described later) which can be readily operated (maneuvered) by the worker to penetrate or bite into the material making up the pole to hold the lanyard in position on the pole. The first gripping means is releasable to enable the worker to sequentially secure and release the lanyard to the pole to enable him/her to climb to any desired position on the pole in an easy and expeditious manner. In addition to serving as a climbing aid, the lanyard 20 of this invention serves as a fall arresting device to ensure that the worker doesn't fall from his/her position on the pole in the event that his/her gaffs 24, lose their grip (release). To accomplish that end the lanyard also includes second gripping means which are arranged to operate, e.g., penetrate the pole, in automatic response to a sharp pulling on the lanyard, such as would occur when the worker's gaff's release.

The lanyard 20 is arranged to be releasably connected to any suitable safety device worn by the worker 24 as he/she is on the pole 26. As can be seen in FIG. 1 the safety device worn by the worker is a conventional belt 28 worn about the waist of the worker. The belt 28 includes a pair of conventional connector members, e.g., conventional D-rings 28A (only one of which can be seen), mounted at positions adjacent the worker's hips. These D-rings 28A serve as the means for releasably connecting the fall arresting lanyard 20 to the worker's safety belt 28.

Figure 2:
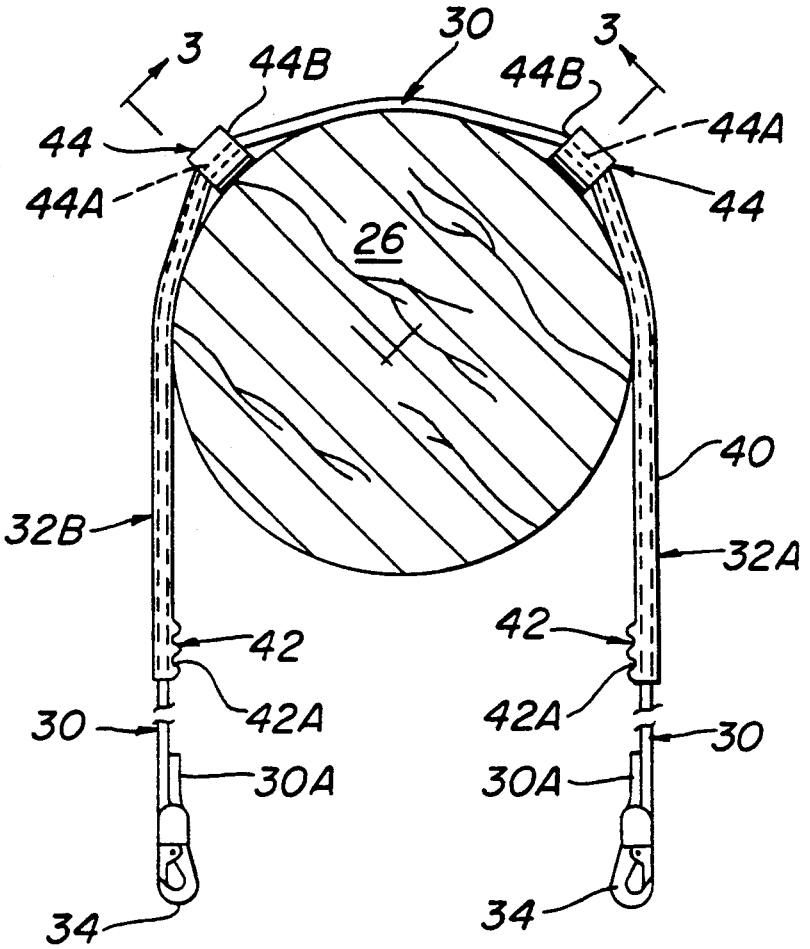
FIG. 2 is a top plan view, partially in section, showing the lanyard of FIG. 1 in engagement with a typical pole.

Referring now also to FIG. 2 the details of the lanyard 20 will now be described. As can be seen therein the lanyard 20 basically comprises an elongated web or strap 30, and a pair of pole gripping units 32A and 32B. The units 32A and 32B will be described in detail later. Suffice it for now to state that each unit is of identical construction to the other except that they are mirror images of each other. Each of the units 32A and 32B is arranged to be manually operated or maneuvered by the worker to cause the aforementioned gripping portions thereof to dig into the material forming the pole to thereby releasably secure the lanyard 20 thereto.

In accordance with a preferred aspect of this invention the strap 30 is formed of a strong, light weight, flexible, material, e.g., leather, woven polyester, nylon, KEVLAR (Registered Trademark) etc, and has a pair of free ends 30A. Each free end of the strap 30 includes a conventional spring-loaded clasp 34 fixedly secured thereto. In this regard, each free end 30A of the strap 30 extends through a hole (not shown) in an associated clasp 34 and is folded over itself to form a respective loop. Each loop is closed off by plural lines of stitches to fixedly secure the clasp thereto. If desired, rivets may also be provided to strengthen the connection. Moreover, if desired, the inside of each loop may contain a conventional guard (not shown) of metal or some other durable material to prevent the clasp 34 from frictionally damaging the lanyard section to which it is secured.

Each clasp 3 is arranged to be releasably secured to a respective one of the two D-rings 28A on the worker's safety belt 28. It should be pointed out at this juncture that other types of releasably securable connectors, e.g., carabiners, etc., can be used in lieu of the spring-loaded clasps 34.

Figure 4:
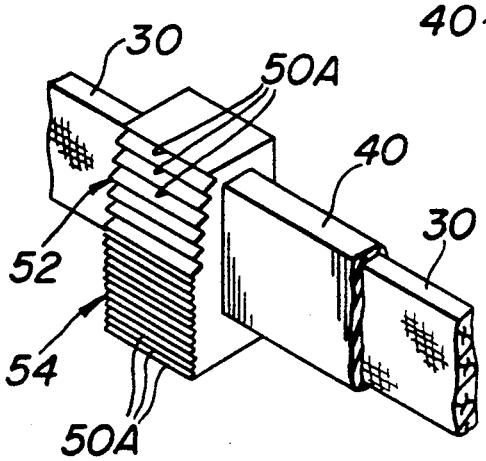
FIG. 4 is an enlarged isometric view of a portion of the lanyard shown in FIG. 1.
Figure 3:
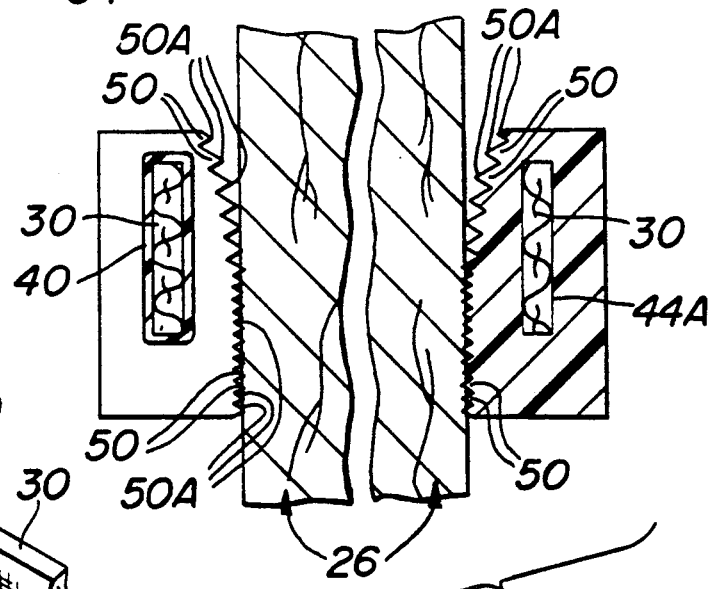
FIG. 3 is an enlarged sectional view taken along line 3—3 of FIG. 2.

Since the units 32A and 32B are identical only one of which will be described in detail hereafter. Thus, as can be seen in FIGS. 2–4 the unit 32A comprises an elongated tube section 40 having a handgrip 42 at one end thereof and a pole engagement and penetration head 44 at the opposite end thereof. The tube section 40 is an elongated, e.g., approximately 18 inches long, member which is of generally arcuate shape and which has a hollow rectangular cross section (see FIGS. 3 and 4). In accordance with a preferred embodiment of this invention the material making up the tube section 40 is either rigid or semirigid to facilitate the operation of the pole engagement and penetration head (as will be described later). Thus, the tube 40 may be formed of any suitable material, e.g., reinforced fiberglass.

The strap 3 is arranged to be extended through each tubular section 40 so that when the clasps 34 at its free ends 30A are connected to the worker's belt the lanyard 20 forms a closed loop. That loop is arranged to encircle the pole 26 on which the worker is disposed (as shown in FIG. 1 and as will be described later). When used in this manner if the position of the worker's safety belt is at the same height as heads 44 at the ends of the tubular sections 40 of the lanyard the loop formed by the lanyard 20 about the pole will be horizontal, i.e., the loop will lie in a generally horizontal plane. If however the position of the worker's belt is below the heads 44 the loop will extend at a downward angle from the horizontal plane, with the degree of that angle depending upon the vertical position of the worker's safety belt with respect to the location of the heads 44 on the pole.

The handgrip 4 is at the end of the section 40 which is located adjacent to the worker 22 so that the worker can manipulate the unit to cause its head 44 to engage and penetrate the material of the pole (as will be described in detail later) by grasping the handgrip. In the interest of ergonomics the handgrip includes a plurality of finger receiving grooves 42A. In the preferred embodiment of this invention the handgrip is formed as an integral unit with the tube section 40, e.g., they are molded as a unit. Alternatively, the handgrip 42 may be in the form of a molded resilient material, e.g., rubber, member which is disposed on the end of the tube section 40. Irrespective of the way that the handgrip is formed, its end (i.e., the end of the tubular section 40 at the handgrip 42) is open so that a respective free end 30A of the strap 30 can extend therethrough a described above.

Referring now to FIGS. 3 and 4 it can be readily seen that the pole engaging and penetrating head 44 basically comprises an enlarged member located at the opposite end of the tubular section 40 as the handgrip portion 42. The head 44 includes a passageway 44A (FIGS. 1 and 3) extending therethrough and terminating in an opening 44B (FIG. 1). That passageway and opening enable the lanyard strap 30 to extend through the gripping unit of which the head 44 is a part. In particular the strap 30 extends through the gripping unit 32A by passing through the opening in the end of its handgrip 42, through the interior of its tubular section 40, through the passageway 44A in its head and out through the opening 44B. From there the strap extends into the gripping unit 32B by entering through the opening 44B in its head, through its passageway 44A, through its tubular section 40, through its handgrip portion 42 and out through the opening at the end of that handgrip portion.

Each head 44 includes a plurality of pole-penetrating elements projecting therefrom. These elements are arranged to engage the surface of the pole on the opposite side from the position of the worker and to penetrate into that material when the gripping units are operated by the worker. To that end, and in accordance with one preferred embodiment of this invention, the penetrating elements comprise a plurality of teeth 50, each having a linear cutting edge 50A. The teeth are oriented so that their cutting edges lie in respective planes extending parallel to the plane of the portion of the loop formed by the tubular sections 40 when the lanyard is in use.

The teeth 50 are divided into two groups, namely, an upper group 52 (FIG. 4) and a lower group 54 (FIG. 4). The teeth 50 of the upper group 52 are larger than the teeth 50 of the lower group 54, with the grooves between the cutting edges of immediately adjacent upper teeth being deeper than the grooves between the cutting edges of immediately adjacent lower teeth. The cutting edges of the teeth of the lower group lie in a common vertically oriented plane, while the cutting edges of the teeth of the upper group are disposed slightly back from the cutting edges of the lower group. These features contribute to the expeditious penetration of all of the cutting edges into the material making up the pole during normal use of the lanyard, as well as the expeditious penetration of the cutting edges of the upper (larger) teeth during emergency gripping operations (as will be described later).

The cutting edges 50A of the teeth of the lower group are arranged to penetrate the material making up the pole when the gripping units 32A and 32B are manipulated by the worker to bring them into engagement with the pole. This action constitutes what may be referred to as the "normal gripping" operation. Such an operation is typically carried out when the worker utilizes the lanyard to climb the pole. In particular, the worker grasps the handgrips to move the gripping units 32A and 32B with respect to each other so that the cutting edges 50A of each of the teeth penetrate (cut into) the material making up the pole 26. This action releasably secures the lanyard on the pole against slippage since the cutting edges of all of the teeth are oriented horizontally. In addition the lanyard strap located between the heads 44 of the two units 32A and 32B frictionally engages the pole to provide further holding power.

Once the lanyard has been secured to the pole as just described the worker can use his/her gaffs 24 to climb up or down the pole to another elevation, without fear of falling. When it is necessary to move the lanyard to another position on the pole all that is required is for the worker to grasp the handgrips 42 to move the gripping units 32A and 32B so that the cutting edges 50 of the lower teeth disengage from the pole (the engagement of the worker's gaffs into the pole serve to prevent the worker from falling during the release of the lanyard from the pole). The fact that the lower teeth 54 have shallower grooves between them ensures that they do not penetrate deeply into the material making up the pole, thereby facilitating the release of all of the teeth from the pole when the lanyard is to be moved.

Once the tubular sections 40 of the units 32A and 32B have been manipulated so that the teeth of each head 44 are disengaged (released) from the material of the pole, the lanyard can then be slid up or down the pole to the new position. After the lanyard is at the new position the gripping units 32A and 32B are again manipulated by the worker to cause the teeth thereof to penetrate into the pole at the new position, to thereby secure the lanyard in place at that position.

As mentioned earlier, the cutting edges 50A of the larger upper teeth 52 are arranged to bite into or penetrate the pole 26 under emergency conditions (or in the event that the worker should initiates a sharp pull on the free ends 30A of the strap 30). For example, if the worker should begin to slip or fall off of the pole due to the release of his/her gaffs (or in the unlikely event that the lower teeth release), such an occurrence being referred to as "emergency operation", a pulling force will be directed onto the ends 30A of the strap. This force automatically causes the cutting edges of the upper teeth to penetrate into the material making up the pole. In particular, if the worker begins to fall a sharp downward force will be transmitted to the ends 30A of the strap by the worker's belt. This downward force pulls on the strap 30 in a downward direction, whereupon the upper portion of the head 44 of each gripping unit 32A and 32B rocks (pivots) inward, i.e., toward the pole 26. This rocking action brings the cutting surfaces 50A of the upper teeth 52 into engagement with the surface of the pole. Moreover, the downward force is applied rapidly and is of considerable intensity, with the intensity being a function of the weight of the worker, so that the cutting edges 50A of the upper teeth are brought somewhat deeply into the material making up the pole. This action immediately prevents the lanyard from sliding down the pole. Accordingly, once the worker has recovered he/she may reengage his/her gaffs in the pole to reestablish support. Then he/she may reset the gripping units to their normal penetration orientation, i.e., where the cutting edges of the lower teeth penetrate shallowly into the pole.

As discussed earlier the head 44 forms an extension of the tubular section 40. In fact, in the preferred embodiment of this invention the head 44 and tubular section 40 are formed as an integral unit. That need not always be the case. Hence, the gripping units of the lanyard of the subject invention may make use of a head which is either fixed or moveable with respect to the tubular section, so long as the head includes some means, e.g., teeth, blades, spikes, etc., arranged to penetrate into the material making up the pole when the tubular sections are manipulated to bring those means into engagement with the pole. Such penetrating means may be formed of any suitable material, e.g., metal, plastic, etc.

Figure 5:
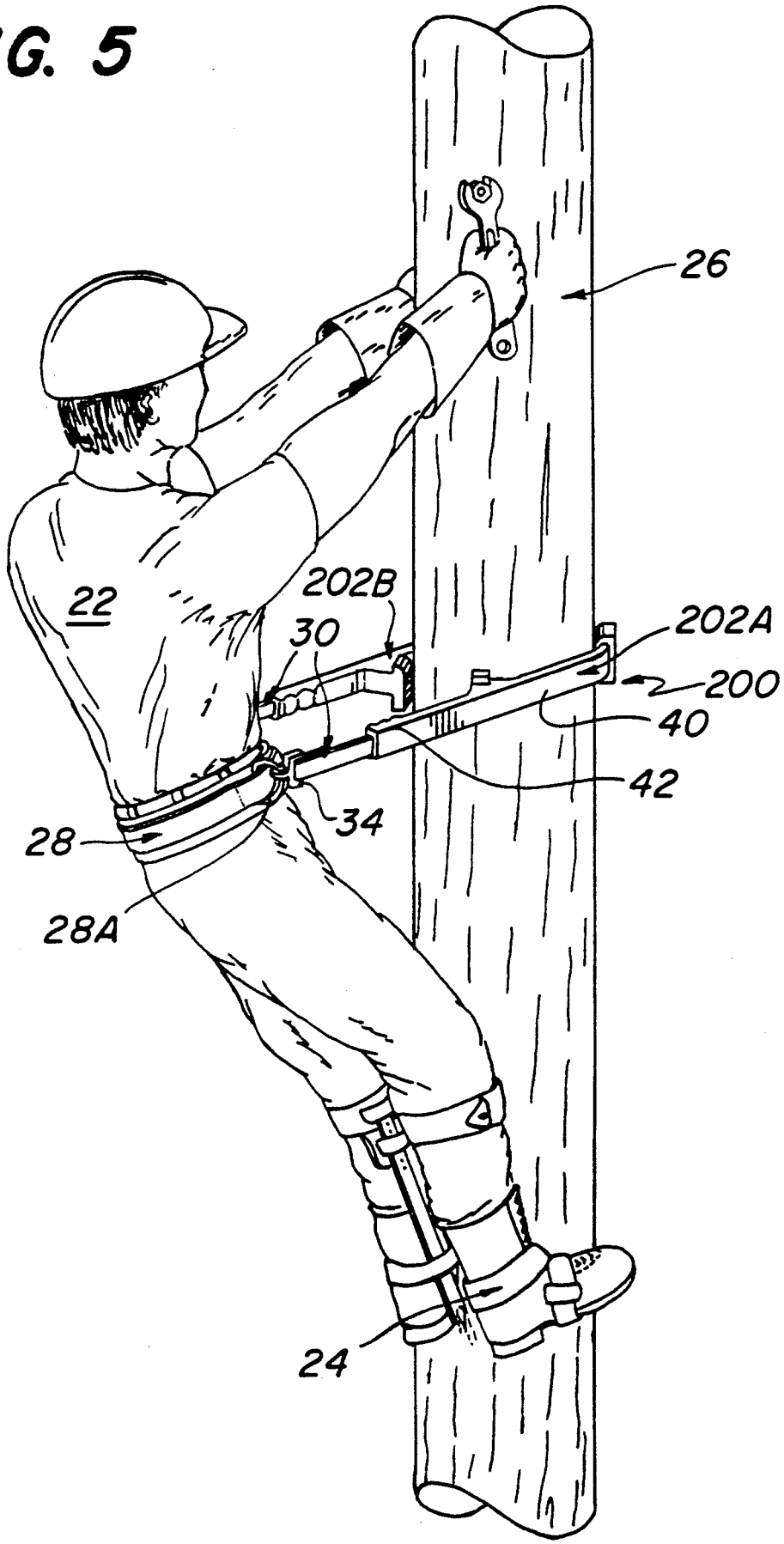
FIG. 5 is an isometric view of a worker using another embodiment of a fall arrest lanyard of the subject invention.

In FIG. 5 there is shown a fall arrest lanyard 200 constructed in accordance with another embodiment of this invention. The lanyard 200 is similar in construction to lanyard 20, except that it includes two additional penetrating heads (to be described later) to provide additional gripping action in the event that the worker begins to fall. In the interests of brevity the details of the common structural elements and their operation will not be reiterated. However those common structural elements will be given the same reference numbers. Thus, as can be seen in FIG. 5 the lanyard 200 basically comprises an elongated web or strap 30, and a pair of pole gripping units 202A and 202B. These units 202A and 202B are described in detail later. Suffice it for now to state that each unit is of identical construction to the other except that they are mirror images of each other. Each of the units 202A and 202B is arranged to be manually operated or maneuvered by the worker in a similar manner as that described with reference to the lanyard 20 to cause selected gripping portions thereof to dig into the material forming the pole to thereby releasably secure the lanyard 200 thereto.

Figure 6:
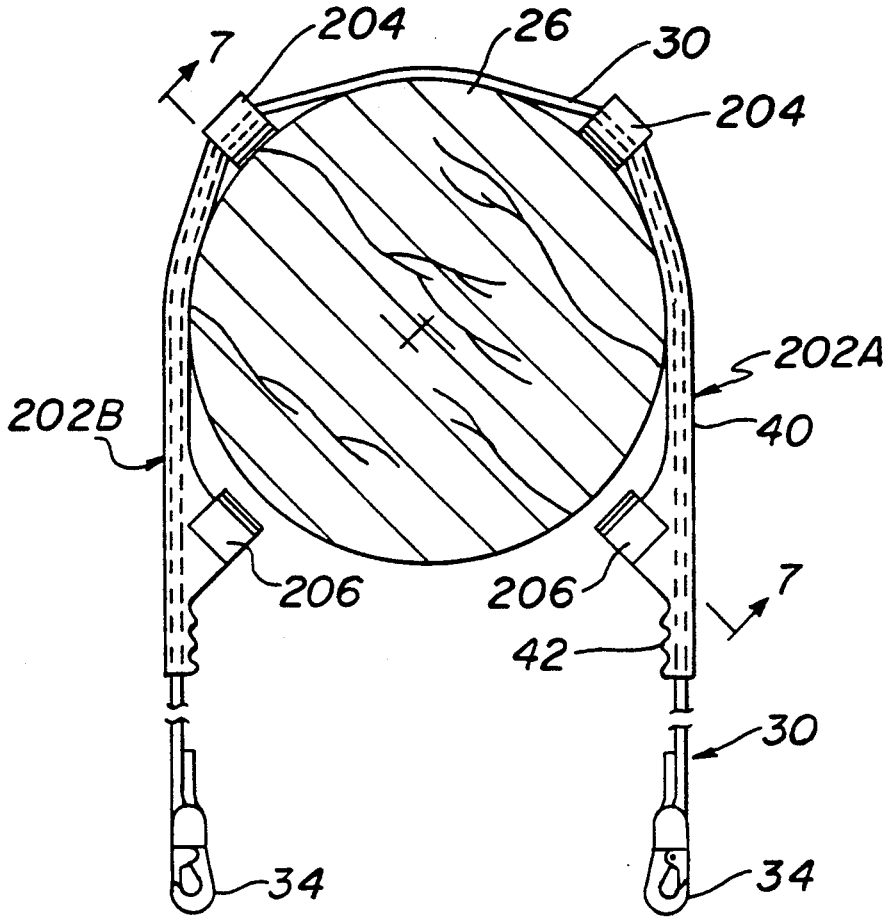
FIG. 6 is a top plan view, partially in section, showing the lanyard of FIG. 5 in engagement with a typical pole.
Figure 7:
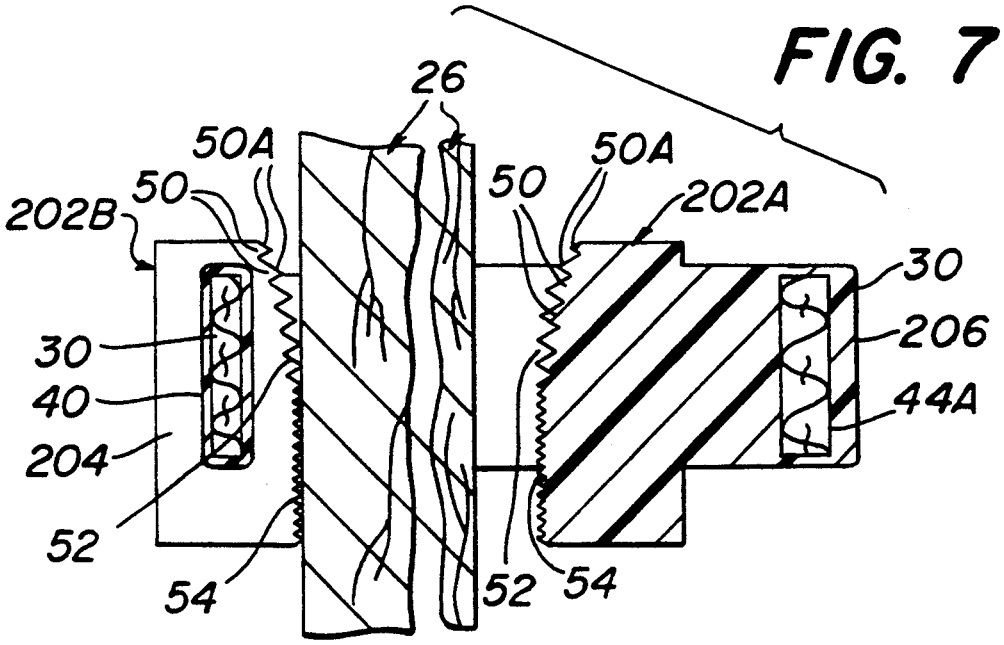
FIG. 7 is an enlarged sectional view taken along line 3—3 of FIG. 6.

Since the units 202A and 202B are identical only one of which will be described in detail hereafter. Thus, as can be seen in FIGS. 6 and 7 the unit 202A comprises an elongated tube section 40 having a handgrip 42 at one end thereof and a first or rear pole engagement and penetration head 204 at the opposite end thereof. The rear head 204 is constructed in an identical manner a the head 44 of lanyard 20 and thus includes a plurality of pole penetrating cutting edges of its upper and lower teeth. A second or front pole engagement and penetration head 206, also constructed in an identical manner to the pole engagement head 44 of lanyard 20, is fixedly mounted on the tube section 40 immediately adjacent the handgrip 42 (as can be seen in FIGS. 5 and 6). Thus, the front head 206 also includes a plurality of pole-penetrating cutting edges of its upper and lower teeth projecting therefrom.

The cutting edges on the teeth of the front head 206 of the gripping unit 202A and 202B are arranged to engage the surface of the pole on the side of the pole adjacent the worker and to penetrate into that material in the event that the rear pole engagement heads 44 fail to grip sufficiently in emergency operation. In this regard in the event that the rear pole engagement heads fail to grip sufficiently, whereupon the worker begins to drop, the sharp downward force of the dropping worker will be transmitted to the ends 30A of the strap by the worker's belt. This downward force pulls on the strap 30 in a downward direction, whereupon the front gripping heads 204 of the gripping unit 202A and 202B rock (pivot) inward, i.e., toward the front portion (i.e., the portion adjacent the worker) of the pole 26. This rocking action brings the cutting surfaces 50A of the upper teeth 52 of those heads into engagement with the surface of the pole. Moreover, the downward force is applied rapidly and is of considerable intensity, with the intensity being a function of the weight of the worker, so that the cutting edges 50A of the upper teeth are brought somewhat deeply into the material making up the pole. This action immediately prevents the lanyard from sliding further down the pole. Accordingly, once the worker has recovered he/she may reengage his/her gaffs in the pole to reestablish support. Then he/she may reset the gripping units 202A and 202B to their normal penetration orientation, i.e., where the cutting edges of the lower teeth 54 of the rear heads 204 penetrate shallowly into the pole 26. This action is accomplished by manipulating the gripping units 202A and 202B by their respective handles 42.

Without further elaboration, the foregoing will so fully illustrate my invention that others may, be applying current or future knowledge, adopt the same for use under various conditions of service.

I claim:

1. A fall arrest lanyard for a worker located at an elevated position on a pole, said lanyard comprising a flexible strap and a pair of separate gripping units, said strap having a central longitudinal axis and being arranged to be releasably connected to said worker to form a generally horizontal loop encircling said pole, each of said gripping units comprising an elongated tubular member and first and second penetrating heads, said tubular member having a first end portion and a second end portion, said strap extending through each of said tubular members, each of said first end portions being located adjacent said worker and arranged to be grasped in a respective hand of said worker, said first penetrating heads being coupled to said first end portions of respective ones of said tubular members, said second penetrating heads being coupled to said second end portions of respective ones of said tubular members, said gripping units being movable by said worker to cause said first and second penetrating heads to dig into the material making up said pole.

2. The lanyard of claim 1 wherein said first end portion includes plural finger-receiving grooves therein.

3. The lanyard of claim 1 wherein each of said elongated tubular members is rigid or semirigid.

4. The lanyard of claim 1 wherein said strap comprises a pair of connectors, each of which is arranged to be releasably secured to said worker.

5. The lanyard of claim 1 wherein each of said elongated tubular members is of a hollow rectangular cross section.

6. The lanyard of claim 1 wherein each of said penetrating heads comprise a plurality upper and lower cutting edges projecting outward from the associated end portion of said tubular member, each of said edges extending generally horizontally when said loop is horizontal.

7. The lanyard of claim 6 wherein said lower edges are disposed closer to each other than said upper edges.

8. The lanyard of claim 6 wherein said first end portion includes plural finger-receiving grooves therein.

9. The lanyard of claim 6 wherein said lower edges are disposed closer to each other than said upper edges.

10. The lanyard of claim 6 wherein each of said elongated tubular members is rigid or semirigid.

11. The lanyard of claim 6 wherein said strap comprises a pair of connectors, each of which is arranged to be releasably secured to said worker.

12. The lanyard of claim 6 additionally comprising plural grooves, with each groove being located between respective immediately adjacent, cutting edges, and wherein the grooves between said lower cutting edges are shallower than the grooves between said upper cutting edges.

13. The lanyard of claim 6 wherein each of said elongated tubular members is of a hollow rectangular cross section.

14. The lanyard of claim 13 wherein said tubular member and said first and second end portions are formed as an integral unit.

* * * * *